US005752810A

United States Patent [19]

Hein

[11] Patent Number: 5,752,810

[45] Date of Patent: May 19, 1998

[54] PUMP WITH AN INTEGRAL CLUTCH

[75] Inventor: Dave W. Hein, Oakdale, Minn.

[73] Assignee: Horton, Inc., Minneapolis, Minn.

[21] Appl. No.: 690,533

[22] Filed: Jul. 31, 1996

[51] Int. Cl.[6] ..... F04B 9/00; F01C 21/00

[52] U.S. Cl. ..... 417/319; 418/69; 192/85 AA

[58] Field of Search ..... 418/69; 417/319; 192/85 AA

[56] References Cited

U.S. PATENT DOCUMENTS

| | | | |
|---|---|---|---|
| 3,887,051 | 6/1975 | Bignell | 192/85 AA |
| 4,715,800 | 12/1987 | Nishizawa et al. | 418/69 |
| 5,012,908 | 5/1991 | Kobayashi et al. | 192/85 AA X |
| 5,261,517 | 11/1993 | Hering | 192/85 AA X |

FOREIGN PATENT DOCUMENTS

| | | | |
|---|---|---|---|
| 2-45680 | 2/1990 | Japan | 418/69 |

*Primary Examiner*—Charles G. Freay
*Attorney, Agent, or Firm*—Peterson, Wicks, Nemer & Kamrath, P.A.

[57] ABSTRACT

A pump (10) is disclosed including an integral clutch and including a housing (26) divided into a clutch zone and a pump zone by a dividing wall (58). An input shaft (12) including a clutch spider (16) is rotatably mounted by a ball roller bearing (54) to a clutch end plate (50). An output shaft (14) is rotatably mounted by linear roller bearings (62, 76) to a pump end plate (68) and the dividing wall (58). A disk pack (20) is slideably mounted to the clutch spider (16) and the output shaft (14) and sandwiched by a piston (34) moved by fluid pressure outward relative to a pressure cylinder (36) and against a pressure plate (28) removably connected to the axial end of the output shaft (14). Thus, axial clutch actuation loads are transmitted only through the disk pack (20) and not to any of the bearings (54, 62, 76). The free axially outer end of the output shaft (14) extends through the pump zone and is located in the pump end plate (68). Clutch actuation fluid is communicated without bearings by first and second passages (96) extending from the pressure cylinder (36) and intersecting with an axial bore (94) in the output shaft (14) into which fluid is introduced by a rotary union (98) carried by the output shaft (14) and the pump end plate (68).

20 Claims, 1 Drawing Sheet

PUMP WITH AN INTEGRAL CLUTCH

BACKGROUND

The present invention generally relates to pumps, particularly relates to pumps including a clutch to engage and disengage the pump, more particularly relates to pumps including a clutch integral with the pump housing, and more particularly relates to pumps including an integral clutch which does not transmit clutch actuation loads through bearings.

Standard gear pumps are used extensively in mobile markets for powering auxiliary equipment. Typical mobile applications that use gear pumps are trash compactors, construction equipment, cranes, and the like. These gear pumps are directly coupled to the front crankshaft by means of a driveshaft, or are mounted to a power take off on the transmission or engine. When coupled directly to the crankshaft, the pump is always rotating, causing fluid to flow and requiring energy from the engine. This energy usage requires fuel. Therefore, by always running the pump, fuel is used by the engine, reducing the fuel efficiency of the vehicle.

Clutches are currently available to engage and disengage the pump. When the pump is disengaged, fuel is not being consumed due to the moving of fluid. However, these clutches are typically expensive and are not robust enough to live in many mobile environments.

Some pump manufacturers produce pumps with clutches integral with the pump housing. However, all of these designs require the clutch actuation loads to be transmitted through a bearing. These loads cause the bearings subjected to the loads to wear out and require replacement.

Thus, a need continues to exist for pumps with an integral clutch for engaging and disengaging the pump and which does not transmit axial loads through bearings to extend the effective bearing life and service requirements of the pump.

SUMMARY

The present invention solves this need and other problems in the field of powering auxiliary equipment for mobile environments by providing, in the preferred form, a pump with an integral clutch where the input shaft and output shaft can be selectively interfaced between engaged and disengaged conditions without transmission of axial clutch actuation loads through the input and output shafts to the bearings which rotatably mount the input and output shafts to the housing.

In other aspects of the present invention, a pump with an integral clutch is provided where the actuation fluid for the actuation of the clutch is introduced through a rotary union carried by the pump end plate and the axial free outer end of the output shaft and in a bearingless design.

It is thus an object of the present invention to provide a novel pump with an integral clutch.

It is further an object of the present invention to provide such a novel pump with an integral clutch where axial loads are not transmitted to any bearing to effectively extend bearing life infinitely.

It is further an object of the present invention to provide such a novel pump with an integral clutch where clutch parasitic losses are minimal.

It is further an object of the present invention to provide such a novel pump with an integral clutch minimizing residual drag between the interface surfaces of the clutch in its disengaged condition.

It is further an object of the present invention to provide such a novel pump with an integral clutch which is fluid actuated, with the actuation fluid provided to a rotating pressure cylinder without the use of bearings.

It is further an object of the present invention to provide such a novel pump with an integral clutch which is modular in design.

It is further an object of the present invention to provide such a novel pump with an integral clutch which can be configured for several possible mounting configurations while using a standard internal package.

It is further an object of the present invention to provide such a novel pump with an integral clutch which prevents contamination between the clutching and pumping components.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
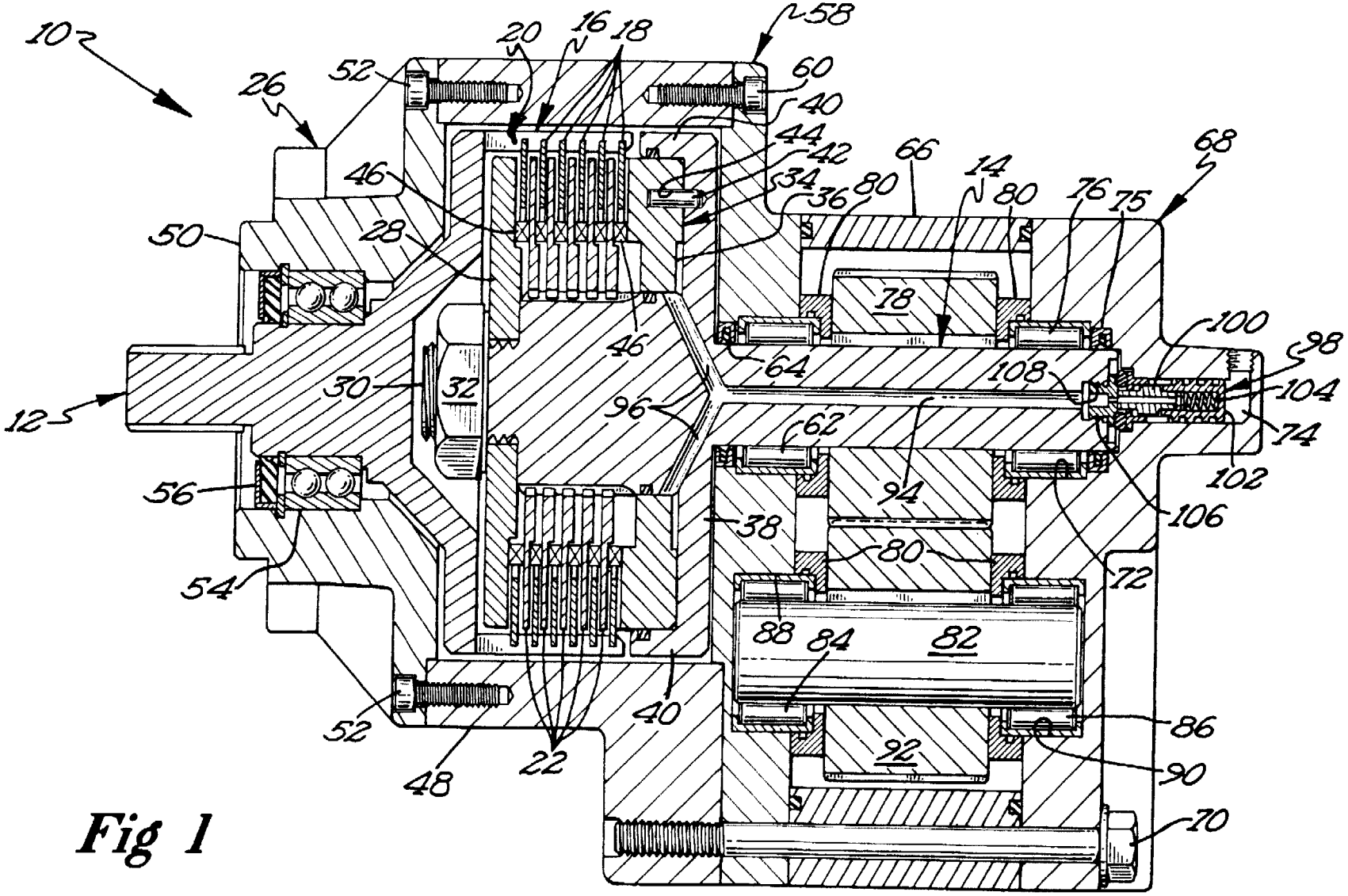
FIG. 1 shows a cross-sectional view of a preferred form of a pump with an integral clutch according to the preferred teachings of the present invention.

The Figure is drawn for ease of explanation of the basic teachings of the present invention only; the extensions of the Figure with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the Figure of the drawings, the same numerals designate the same or similar parts. Furthermore, when the terms "top", "bottom", "first", "second", "inside", "inward", "outside", and similar terms are used herein, it should be understood that these terms have reference only to the structure shown in the drawings as it would appear to a person viewing the drawings and are utilized only to facilitate describing the invention.

DESCRIPTION

A pump with an integral clutch according to the preferred teachings of the present invention is shown in the drawings and generally designated 10. Pump 10 generally includes a power input shaft 12 and an output shaft 14 which are rotatably mounted in housing 26 such that shafts 12 and 14 and housing 26 are rotatably mounted with respect to each other. Input shaft 12 carries a first rotational interfacing element shown as a clutch spider 16 engaged with alternate disks 18 of a disk pack 20 which has intervening disks 22 keyed to output shaft 14.

According to the teachings of the present invention, pump 10 includes a pressure plate 28 removably attached to the free axial inner end of output shaft 14 by any suitable means intermediate spider 16 and disk pack 20 and inside of housing 26. In the preferred form, pressure plate 28 is annular in shape and the free axial inner end of output shaft 14 includes and terminates in a reduced diameter, threaded portion 30 which extends through the central opening of pressure plate 28. A nut 32 is threadably received on portion 30 and can be tightened thereon to sandwich pressure plate 28 against the shoulder of the free axial inner end of output shaft 14 defined by portion 30.

An annular piston 34 is slideably mounted on output shaft 14 on the opposite side of disk pack 20 than pressure plate 28 and with pressure plate 28 for selectively sandwiching disks 18 and 22 together. An annular pressure cylinder 36 is formed and defined on output shaft 14 for the slideable receipt of annular piston 34. In the preferred form, cylinder 36 is defined by an annular disk 38 integrally extending radially from output shaft 14 and integrally terminating in an axially extending annular flange 40. Suitable sealing means can be provided for preventing the escape of fluid under pressure around piston 34 inside of pressure cylinder 36 such as a first O-ring located in a groove on the outside surface of output shaft 14 and a second O-ring located in a groove on the inside surface of flange 40 inside of pressure cylinder 36. Torque pins 42 extend axially from disk 38 and are slideably received in corresponding bores formed in piston 34 for preventing relative rotation between piston 34 but allowing relative axial movement. Suitable provisions 46 such as wave springs are provided between disks 22 and between the axially outer disks 22 and pressure plate 28 and piston 34. It should be appreciated that wave springs 46 act to separate disks 22 from each other and from pressure plate 28 and piston 34 and also act to move piston 34 into pressure cylinder 36.

Housing 26 according to the preferred teachings of the present invention generally includes a clutch central housing portion or sleeve 48 of a generally cylindrical shape having a circular cross section inner surface. An annular pilot or clutch end cap or plate 50 is removably secured to an axial end of sleeve 48 such as by socket head cap screws 52 which are countersunk in end cap 50 and threaded into sleeve 48. Input shaft 12 is rotatably mounted within end cap 50 such as by a double row ball roller bearing 54. A suitable seal 56 can be provided between shaft 12 and the inner diameter of end cap 50 and abutting with the snap rings holding the outer axial end of bearing 54.

Housing 26 further includes an annular end cap 58 removably secured to the opposite axial end of sleeve 48 than end cap 50 such as by socket head cap screws 60 which are countersunk in end cap 58 and threaded into sleeve 48. Output shaft 14 is rotatably mounted within end cap 58 such as by a linear roller bearing 62 and independent of input shaft 12. A suitable seal 64 can be provided between shaft 14 and the inner diameter of end cap 58 and located axially inward of bearing 62.

It should be appreciated that sleeve 48, end caps 50 and 58, shafts 14 and 16 and seals 54 and 64 in the most preferred form define a closed, oil chamber or clutch zone in which disk pack 20, pressure plate 28, piston 34, and cylinder 36 are located. Thus, pump 10, in its most preferred form, is shown as being of the closed, oil film interface type which is particularly adaptable for use in environments such as in the food industry where it is extremely undesirable for worn interface particles to exit the apparatus, in environments where the low replacement of oil film interfaces is desirable, and/or in environments where high torque requirements of multiple interfaces is desirable, including but not limited to for powering auxiliary equipment for mobile applications. It can be appreciated that these oil film type rotational interfacing elements of pump 10 can take other forms and constructions than the preferred form shown in the drawings. For example, disk pack 20 can take other forms of selective interfacing and rotationally relating members such as but not including friction interface disks and the like.

However, the oil film type interface of the most preferred form of the present invention is believed to be particularly advantageous for several reasons. Specifically, disk pack 20 immersed in oil in housing 26 of the preferred form allows for rapid engagement and disengagement as the heat generated from actuation is dissipated into the oil and drawn therefrom through housing 26. The separation of disks 22 such as by wave springs 46 in the most preferred form ensures that positive disengagement is achieved and thereby minimizing the residual drag between disks 18 and 22 such that the parasitic losses when disengaged are minimal. Further, all clutch actuation axial loads are transmitted only through disks 18 and 22 and not through spider 16 and shafts 12 and 14. Thus, no axial loads are transmitted through bearings 54 and 62 so that bearing life is effectively infinite. Servicing of disk pack 20 can be easily performed by removing end cap 50 such as by unthreading cap screws 52 and by removing nut 32. In this regard, the use of wave springs 46 is advantageous as disk pack 20 is not under relatively great compression forces and will not fly apart when nut 32 is removed and is readily reassembled with the tightening of nut 32 providing the necessary compression forces to disk pack 20. Additionally, due to the modular design of housing 26, end caps 50 having pilots and shafts 12 conforming to either SAE, DIN, ISO, or similar standards can be secured to sleeve 48 and disk pack 20 of a standardized design. Thus, pump 10 can be easily configured for several possible mounting configurations by only changing input shaft 12 and/or end cap 50. Thus, inventory requirements and production costs are minimized.

Housing 26 according to the preferred teachings of the present invention generally includes a pump central housing portion or sleeve 66 having a generally oval cross section inner surface. Housing 26 further includes a pneumatic or pump end cap or plate 68 of a size and shape corresponding to the cross section of sleeve 66. One axial end of sleeve 66 flushly abuts with and is removably secured to end cap 58 and the other axial end of sleeve 66 flushly abuts with and is removably secured to end cap 68 such as by through rods 70 extending through end cap 68 and sleeve 66 and threaded into end cap 58. Suitable seals can be provided between sleeve 66 and end caps 58 and 68 such as O-rings located in grooves in the axial ends of sleeve 66.

An enlarged bore 72 extends from the inner axial end towards but spaced from the outer axial end of end cap 68. A reduced diameter bore 74 extends from bore 72 to the outer axial end of end cap 68. Output shaft 14 is rotatably supported within end cap 68 such as by a linear roller bearing 76 received in bore 72 and for receipt on output shaft 14 and independent of input shaft 12. A suitable seal 75 can be provided between shaft 14 and bore 72 intermediate the axial end of shaft 14 and bearing 76. In the most preferred form, seal 75 is a double lipped seal having a first lip for preventing hydraulic oil being pumped by pump 10 from passing toward the axial end of shaft 14 and contaminating the actuation fluid and a second lip for preventing actuation fluid from passing into and contaminating the hydraulic oil or other fluid being pumped. Similarly, in the most preferred form, seal 64 is a double lipped seal having a first lip for preventing oil and other debris from disk pack 20 from passing toward and contaminating the hydraulic oil or other fluid being pumped and a second lip for preventing the hydraulic oil or other fluid being pumped from passing and contaminating disk pack 20 and its oil bath. It should be appreciated that sleeve 66, end caps 58 and 68, output shaft 16 and seals 64 and 78 define a closed chamber or pump zone. As cap 58 forms the ends of both the clutch and pump zones, it functions as a dividing wall to divide the interior chamber of housing 26 into the clutch and pump zones. Thus, output shaft 14 extends from cap 58, through the pump zone of housing 26, and terminates in a free axial outer end located outside of the pump zone.

Pump 10 is in the most preferred form of the gear pump type located in the pump zone for moving fluids such as hydraulic oil inside thereof and includes a first pump gear 78 operably and rotatably connected to shaft 14 and located in the pump zone of housing 26 intermediate end plates 58 and 68. Thrust bearings 80 can be provided abutting on the opposite axial sides of gear 78 and against bearings 62 and 76. An idler shaft 82 extends parallel to and spaced from shaft 14 and between end plates 58 and 68. In the most preferred form, the opposite axial ends of idler shaft 82 are rotatably supported relative to end plates 58 and 68 by linear roller bearings 84 and 86 received in sockets 88 and 90 formed in the inside surfaces of end plates 58 and 68, respectively. A second pump gear 92 is mounted in the pump zone on idler shaft 82 in gearing relation to gear 78 and rotatable about an axis defined by idler shaft 82. Sleeve 68 includes entrance and exit ports, not shown. It should be appreciated that when gear 78 rotates due to the rotation of shaft 12, gear 92 also rotates due to its gearing relation with gear 78 and hydraulic oil or similar fluid is forced from the entrance port to the exit port in a manner well known in the field of gear pumps.

For the introduction of actuation fluid pressure to cylinder 36, a central axial bore 94 extends from the free axial outer end of shaft 14 towards but spaced from portion 30. First and second passages 96 extend from inside of cylinder 36 intersecting with and in fluid communication with bore 94. A rotary union 98 is provided between shaft 14 and end cap 68 for introducing actuation fluid from a suitable source into bore 94 and thus into cylinder 36 via passages 96. In the most preferred form, rotary union 98 is of the type shown and disclosed in U.S. Pat. No. 3,409,305, which is hereby incorporated herein by reference. In particular, rotary union 96 in the preferred form includes a first seal member 100 axially slideable in a casing 102 sealingly received in bore 74 such that casing 102 and seal member 100 is carried by end cap 68. Seal member 100 is biased outwardly of casing 102 by a spring 104 and sealingly and rotatably abuts with a second seal member 106 received in a counter bore 108 extending from the axial end of shaft 14 and concentric to bore 94. Thus, seal member 106 is carried by output shaft 14. It should be appreciated that rotary air union 98 allows fluid communication between end cap 68 and the source of actuation fluid which are stationary and shaft 14 which rotates relative thereto. It should also be appreciated that providing multiple passages 96 to cylinder 36 ensures that uniform pressure is placed upon piston 34 for moving piston 34 out of cylinder 36 against the bias of wave springs 46 for uniform clutch actuation.

Now that the basic construction of pump 10 according to the preferred teachings of the present invention has been set forth, the operation of pump 10 can be explained and appreciated. For the sake of explanation, it will be assumed that pump 10 has been mounted to an engine with input shaft 12 coupled to the engine crankshaft and thereby is rotated at all times when the engine is running. In the absence of actuation fluid pressure in cylinder 36, wave springs 46 separate intervening disks 22 and move piston 34 into cylinder 36. It should be appreciated that in the absence of actuation fluid pressure, disk pack 20 is in a disengaged condition where input and output shafts 12 and 14 are rotatably independent. It should be appreciated that wave springs 46 ensure that positive disengagement of disks 18 and 22 is achieved minimizing the residual drag therebetween to thereby minimize parasitic losses and energy draw from the engine and increase fuel efficiency. When it is desired to pump hydraulic fluid, actuation fluid is introduced through suitable valving to rotary union 98, into bore 94, into passages 96 and into pressure cylinder 36. Fluid pressure in cylinder 36 acts to move piston 34 outward relative to cylinder 36 towards pressure plate 28 and against the bias of wave springs 46. Disk pack 20 is thereby sandwiched between pressure plate 28 and piston 34 and is in its engaged condition to thereby rotatably relate input and output shafts 12 and 14. In the engaged condition, all axial clutch actuation loads are transmitted only through disks 18 and 22 of disk pack 20 and specifically without transmission of axial loads through shafts 12 and 14 to bearings 54 and 62. It should also be appreciated that the introduction of actuation fluid into bore 94 through the use of rotary union 98 including sealing members 100 and 106 supported by end cap 68 and output shaft 14, respectively, is advantageous as being a bearingless design.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Pump with an integral clutch comprising, in combination: a housing defining an interior chamber divided into a pump zone and a clutch zone by a dividing wall, with the housing further including a clutch end plate; an input shaft; means for rotatably mounting the input shaft in the clutch end plate; an output shaft; means for rotatably mounting the output shaft in the dividing wall and independent of the input-shaft; means located in the pump zone and operatively connected to the output shaft for moving fluid inside of the pump zone of the housing; and means located in the clutch zone for selectively interfacing between the input shaft and output shaft between an engaged condition where the input and output shafts are rotatably related and a disengaged condition where the input and output shafts are rotatably independent and without transmission of axial loads through the input and output shafts to the rotatably mounting means.

2. The pump with the integral clutch of claim 1 wherein the selectively interfacing means comprises, in combination: a clutch spider rotatable with the input shaft and located within the clutch zone; a disk pack including alternate disks slideably engaged inside of the clutch spider and intervening disks slideably engaged to the output shaft inside of the clutch zone; and means located inside of the clutch zone for selectively sandwiching the alternate and intervening disks together.

3. The pump with the integral clutch of claim 2 wherein the selectively interfacing means further comprises, in combination: means for biasing the separation of the intervening disks.

4. The pump with the integral clutch of claim 3 wherein the selectively sandwiching means comprises, in combination: a pressure plate connected to the output shaft; and a piston slideably mounted to the output shaft on the opposite side of the disk pack than the pressure plate.

5. The pump with the integral clutch of claim 4 wherein the output shaft includes a free axial inner end located in the clutch zone, with the pressure plate being removably connected to the free axial inner end of the output shaft intermediate the clutch spider and the disk pack.

6. The pump with the integral clutch of claim 5 wherein the free axial inner end of the output shaft terminates in a reduced diameter threaded portion; wherein the pressure plate is annular in shape and received on the threaded portion; and wherein the pressure plate is removably connected to the output shaft by a nut threaded on the threaded portion and sandwiching the pressure plate against the free axial end of the output shaft.

7. The pump with the integral clutch of claim 4 wherein the selectively sandwiching means further comprises, in combination: a pressure cylinder connected to the output shaft inside of the clutch zone, with the piston being slideably received in the pressure cylinder; and means for providing actuation fluid pressure inside of the pressure cylinder for moving the piston outward relative to the pressure cylinder.

8. The pump with the integral clutch of claim 7 wherein the providing means comprises, in combination: a central axial bore formed in the output shaft; first and second passages extending from inside of the pressure cylinder and intersecting with and in fluid communication with the central axial bore; and means for introducing actuation fluid into the central axial bore.

9. The pump with the integral clutch of claim 8 wherein the housing further includes a pump end plate; and wherein the pump further comprises, in combination: means for rotatably mounting the output shaft in the pump end plate and independent of the input shaft, with the output shaft extending from the dividing wall, through the pump zone, and terminating in a free axial outer end located outside of the pump zone, with the central axial bore extending from the outer end of the output shaft.

10. The pump with the integral clutch of claim 9 wherein the introducing means comprises, in combination: a rotary union including a first seal member carried by the pump end plate and a second seal member carried by the output shaft.

11. The pump with the integral clutch of claim 10 wherein the fluid moving means comprises, in combination: a first gear rotatable with the output shaft and located inside of the pump zone; a second gear rotatable inside of the pump zone and in gearing relation with the first gear.

12. The pump with the integral clutch of claim 11 wherein the fluid moving means further comprises, in combination: an idler shaft supported by and between the dividing wall and the pump end wall, with the second gear being mounted on the idler shaft.

13. The pump with the integral clutch of claim 9 further comprising, in combination: a double lipped seal between the pump end wall and the output shaft having a first lip for preventing contamination from the pump zone with the actuation fluid and having a second lip for preventing contamination from the actuation fluid into the pump zone.

14. The pump with the integral clutch of claim 9 wherein the output shaft rotatably mounting means comprises linear roller bearings.

15. The pump with the integral clutch of claim 14 wherein the input shaft rotatably mounting means comprises ball roller bearings.

16. The pump with the integral clutch of claim 1 further comprising, in combination: a double lipped seal between the dividing wall and the output shaft having a first lip for preventing contamination from the pump zone into the clutch zone and a second lip for preventing contamination from the clutch zone into the pump zone.

17. The pump with the integral clutch of claim 1 wherein the input shaft rotatably mounting means comprises ball roller bearings and the output shaft rotatably mounting means comprises linear roller bearings.

18. Pump with an integral clutch comprising, in combination: a housing defining an interior chamber divided into a pump zone and a clutch zone by a dividing wall, with the housing further including a clutch end plate and a pump end plate; an input shaft; means for rotatably mounting the input shaft in the clutch end plate; an output shaft; means for rotatably mounting the output shaft in the dividing wall and independent of the input shaft; means for rotatably mounting the output shaft in the pump end wall and independent of the input shaft, with the output shaft extending from the dividing wall, through the pump-zone, and terminating in a free axial outer end located outside of the pump zone; means located in the pump zone and operatively connected to the output shaft for moving fluid inside of the pump zone of the housing; and means located in the clutch zone for selectively interfacing between the input shaft and output shaft between an engaged condition where the input and output shafts are rotatably related and a disengaged condition where the input and output shafts are rotatably independent comprising, in combination: a pressure cylinder connected to the output shaft inside of the clutch zone, a piston slideably mounted to the output shaft and slideably received in the pressure cylinder, a central axial bore formed in the output shaft, at least a first passage extending from inside of the pressure cylinder and intersecting with and in fluid communication with the central axial bore, and means for introducing actuation fluid into the central axial bore for moving the piston outward relative to the pressure cylinder.

19. The pump with the integral clutch of claim 18 wherein the introducing means comprises, in combination: a rotary union including a first seal member carried by the pump end plate and a second seal member carried by the output shaft.

20. The pump with the integral clutch of claim 19 wherein the selectively interfacing means further comprises, in combination: a second passage spaced from the first passage and extending from the inside of the pressure cylinder and intersecting with and in fluid communication with the central axial bore ensuring uniform actuation of the piston; a clutch spider rotatable with the input shaft and located within the clutch zone; and a disk pack including alternate disks slideably engaged inside of the clutch spider and intervening disks slideably engaged to the output shaft inside of the clutch zone, with the introduction of fluid pressure into the pressure cylinder moving the piston to sandwich the alternate and intervening disks together.

* * * * *

UNITED STATES PATENT AND TRADEMARK OFFICE

CERTIFICATE OF CORRECTION

PATENT NO. : 5,752,810

DATED : May 19, 1998

INVENTOR(S) : Dave W. Hein

It is certified that error appears in the above-identified patent and that said Letters Patent is hereby corrected as shown below:

Cover page, under item [56], add:

--2,413,081 12/1946 Shaeffer
3,409,305 11/1968 Nieland
5,237,409 12/1993 Swain--.

Column 6, line 39, cancel "input-shaft" and substitute therefor --input shaft--.

Column 8, line 23, cancel "pump-zone" and substitute therefor --pump zone--.

Signed and Sealed this

First Day of September, 1998

*Attest:*

*Attesting Officer*

BRUCE LEHMAN

*Commissioner of Patents and Trademarks*